United States Patent [19]

Rothwarf et al.

[11] 4,213,802

[45] Jul. 22, 1980

[54] METHOD OF TREATING A PERMANENT MAGNET ALLOY

[75] Inventors: Frederick Rothwarf, Toms River; Robert L. Bergner, Randolph; Herbert A. Leupold, Eatontown; Arthur Tauber, Elberon, all of N.J.

[73] Assignee: The United States of America as represented by the Secretary of the Army, Washington, D.C.

[21] Appl. No.: 33,940

[22] Filed: Apr. 27, 1979

[51] Int. Cl.[2] ..... H01F 1/02

[52] U.S. Cl. ..... 148/101; 148/121; 148/31.57

[58] Field of Search ..... 75/152, 153, 170, 173; 148/101, 102, 121, 31.57

[56] References Cited

PUBLICATIONS

"Enhancement of the Magnetic Properties of the $Sm_2Cu_{1.6}Zr_{0.16}Fe_{3.3}Co_{12}$ Compound", Bergner et al., Paper presented 24th Annual Conference on Magnetism and Magnetic Materials, Cleveland, Ohio, Nov. 15, 1978.

"Magnetic Properties of a New Type of Rare-Earth Cobalt Magnets", Ojima et al., IEEE Transactions on Magnetics, vol. MAG-13, No. 5, Sep. 1977.

*Primary Examiner*—L. Dewayne Rutledge
*Assistant Examiner*—John P. Sheehan
*Attorney, Agent, or Firm*—Nathan Edelberg; Sheldon Kanars; Roy E. Gordon

[57] ABSTRACT

The reversible temperature coefficient of magnetization of a permanent magnet alloy is lowered by (a) heating the alloy at about 1200 degrees C. for 2 hours, (b) quenching the alloy in ice water, (c) heating the alloy at about 850 degrees C. for 2 hours, (d) lowering the temperature to about 700 degrees C. and heating for one hour, (e) lowering the temperature to about 600 degrees C. and heating for one hour, (f) lowering the temperature to about 500 degrees C. and heating for one hour, (g) lowering the temperature to about 400 degrees C. and heating for four hours, and (h) lowering the temperature to about 280 degrees C. and heating for 12 hours. The method is particularly effective in lowering the reversible temperature coefficient of magnetization of the permanent magnet alloy $Sm_2Cu_{1.6}Zr_{0.16}Fe_{3.3}Co_{12}$.

4 Claims, No Drawings

METHOD OF TREATING A PERMANENT MAGNET ALLOY

The invention described herein may be manufactured, used and licensed by or for the Government for governmental purposes without the payment to us of any royalty thereon.

This invention relates in general to a method of treating a permanent magnet alloy and in particular to a method of lowering the reversible temperature coefficient of magnetization of the permanent magnet alloy $Sm_2Cu_{1.6}Zr_{0.16}Fe_{3.3}Co_{12}$. This application is copending with U. S. patent application Ser. No. 33,911 filed Apr. 27, 1979 for "Permanent Magnet Materials" and with U.S. patent application Ser. No. 33,939 filed Apr. 27, 1979 for "Magnetic Alloys", the aforesaid applications being filed concurrently herewith and assigned to a common assignee.

BACKGROUND OF THE INVENTION

There is a need in some millimeter wave/microwave devices of low temperature coefficient permanent magnet materials in which the temperature coefficient is low enough such that the variation of remanent magnetization is less than 2 percent over the temperature range of −50 degrees C. to +150 degrees C. The current commercially available $SmCo_5$ based magnets have a rather high reversible temperature coefficient (RTC) of magnetization of 0.044 percent/C.

There has recently been reported a $Sm_2Co_{17}$-based alloy having an improved energy product as compared to $SmCo_5$ based compounds. The alloy has the composition $Sm_2Cu_{1.6}Zr_{0.16}Fe_{3.3}Co_{12}$. Though the alloy has an improved energy product, its reversible temperature coefficient of magnetization is too high.

SUMMARY OF THE INVENTION

The general object of this invention is to provide a method of lowering the RTC of magnetization of permanent magnet materials. A further object of the invention is to provide such a method wherein the permanent magnet material is a $Sm_2Co_{17}$ based alloy. A particular object of this invention is to provide a method of lowering the RTC of magnetization of the alloy $Sm_2Cu_{1.6}Zr_{0.16}Fe_{3.3}Co_{12}$.

It has now been found that the foregoing objects can be attained by heat treating the alloy in a vacuum or in a noble atmosphere according to the schedule:

(a) 1200 degrees C. for 2 hours
(b) quench in ice water
(c) 850 degrees for 2 hours
(d) 700 degrees for 1 hour
(e) 600 degrees for 1 hour
(f) 500 degrees C. for 2 hours
(g) 400 degrees for 4 hours and (h) 280 degrees for 12 hours It is noted that the above described heat treatment differs from the heat treatment as described in the prior art article "Magnetic Properties of a New Type of Rare-Earth Cobalt Magnets" by T. Ojima, S. Tomizawa, T. Yoneyama and T. Hori, IEEE Transactions on Magnetics, Vol MAG-13, No. 5, September 1977 in that the prior art teaches heating at 400 degrees C. for 10 hours as the final step whereas the invention calls for heating at 400 degrees for 4 hours followed by heating at 280 degrees C. for 12 hours.

DESCRIPTION OF THE PREFERRED EMBODIMENT $Sm_2Cu_{1.6}Zr_{0.16}Fe_{3.3}Co_{12}$ is prepared by induction melting the appropriate constituents in a boron nitride crucible in an over-pressure of 60 p.s.i. argon atmosphere in a crystal growing furnace. The cast ingots are then heat treated according to the schedule in the Summary of the Invention. The resulting RTC is −0.022.

When the cast ingots are heat treated according to the method of the prior art, the resulting RTC is −0.040.

Thus the method of the invention improves the temperature coefficient by a factor of about two.

The precise reason that the change in heat schedule affects the RTC of magnetization is not entirely known. What is known however, from microprobe studies, is that a significant variation in the size and composition of the principal and the grain boundary phases occurs with different heat treatments.

We wish it to be understood that we do not desire to be limited to the exact details as described, for obvious modifications will occur to a person skilled in the art.

What is claimed is:

1. Method of lowering the reversible temperature coefficient of magnetization of a permanent magnet alloy said method consisting of heat treating the alloy in a noble gas atmosphere by the steps of (a) heating the alloy at about 1200 degrees C. for 2 hours, (b) quenching the alloy in ice water, (c) heating the alloy at about 850 degrees C. for 2 hours, (d) lowering the temperature to about 700 degrees C. and heating for one hour (f) lowering the temperature to about 500 degrees C. and heating for one hour, (g) lowering the temperature to about 400 degrees C. and heating for four hours, and (h) lowering the temperature to about 280 degrees C. and heating for 12 hours.

2. Method according to claim 1 wherein said permanent magnet alloy is a $Sm_2Co_{17}$ based alloy.

3. Method according to claim 2 wherein said $Sm_2Co_{17}$ based alloy is $Sm_2Cu_{1.6}Zr_{0.16}Fe_{3.3}Co_{12}$.

4. Method according to claim 1 wherein the alloy is heat treated in argon.

* * * * *